US012790749B2

(12) United States Patent
Zhou et al.

(10) Patent No.: US 12,790,749 B2
(45) Date of Patent: Nov. 10, 2026

(54) PULP DISSOLVING DEVICE AND PULP DISSOLVING METHOD FOR REFINED COTTON

(71) Applicants: HUBEI JINHANJIANG REFINED COTTON CO., LTD., Zhongxiang City (CN); JINGMEN INSTITUTE OF PHARMACEUTICAL INDUSTRY TECHNOLOGY, Jingmen City (CN)

(72) Inventors: Hangxu Zhou, Zhongxiang City (CN); Hongju Zhan, Jingmen City (CN); Liwei Li, Jingmen City (CN); Lin Zhao, Jingmen City (CN); Jintao Fan, Zhongxiang City (CN)

(73) Assignees: HUBEI JINHANJIANG REFINED COTTON CO., LTD. (CN); JINGMEN INSTITUTE OF PHARMACEUTICAL INDUSTRY TECHNOLOGY (CN)

( * ) Notice: Subject to any disclaimer, the term of this patent is extended or adjusted under 35 U.S.C. 154(b) by 127 days.

(21) Appl. No.: 18/963,023

(22) Filed: Nov. 27, 2024

(65) Prior Publication Data

US 2026/0028774 A1 Jan. 29, 2026

(30) Foreign Application Priority Data

Jul. 24, 2024 (CN) ..... 202411000092.3

(51) Int. Cl.
*D21D 99/00* (2006.01)

(52) U.S. Cl.
CPC ..... *D21D 99/00* (2013.01)

(58) Field of Classification Search
CPC ..... D21D 99/00; B01D 29/03; B01D 19/20; C08D 1/10
USPC ..... 162/232
See application file for complete search history.

(56) References Cited

U.S. PATENT DOCUMENTS

| | | | | | |
|---|---|---|---|---|---|
| 4,200,537 | A * | 4/1980 | Lamort | B01D 29/33 | 210/415 |
| 4,687,636 | A * | 8/1987 | Hart | C12Q 1/18 | 436/538 |
| 5,244,585 | A * | 9/1993 | Sugimoto | B01D 61/16 | 210/791 |
| 5,964,984 | A * | 10/1999 | Holmbom | B01D 29/01 | 210/791 |
| 2015/0314486 | A1* | 11/2015 | Hayashi | B07B 9/00 | 241/49 |
| 2015/0343450 | A1* | 12/2015 | Floeter | C13B 5/06 | 241/36 |
| 2024/0191001 | A1* | 6/2024 | Zhou | C08B 1/10 | |

* cited by examiner

*Primary Examiner* — Jacob T Minskey

(57) ABSTRACT

Disclosed is a pulp dissolving device and a pulp dissolving method for refined cotton. The device includes a supporting base. A pulp dissolving unit A is installed on the top of the supporting base, and a pulp discharging unit is installed in front of the pulp dissolving unit A. A pulp dissolving unit B is installed on the right side of the pulp dissolving unit A, and a pulp dissolving unit C is installed on the pulp dissolving unit A and the pulp dissolving unit B. The number of stirring shafts is two, and the two stirring shafts are rotationally installed on a pulp dissolving frame. The number of stirring supports is two rows, and the two rows of stirring supports are welded to the outside of the two stirring shafts.

8 Claims, 10 Drawing Sheets

PULP DISSOLVING DEVICE AND PULP DISSOLVING METHOD FOR REFINED COTTON

CROSS-REFERENCE TO RELATED APPLICATIONS

This application claims priority to Chinese Application No. CN202411000092.3, having a filing date of Jul. 24, 2024, the entire contents of which are hereby incorporated by reference.

TECHNICAL FIELD

The present disclosure belongs to the technical field of pulp dissolving devices, and more specifically relates to a pulp dissolving device and a pulp dissolving method for refined cotton.

BACKGROUND OF THE INVENTION

In the production of refined cotton, it is often necessary to dissolve pulp cut and screened from refined cotton and reworked pulp to produce rolled sheet products. At present, in most of conventional pulp dissolving methods in the industry, pulp is dissolved by stirring rods. The pulp dissolving methods are single, long in pulp dissolving time and not high in uniformity of dissolved cotton pulp.

SUMMARY OF THE INVENTION

In order to solve the above-mentioned technical problem, the present disclosure provides a pulp dissolving device and a pulp dissolving method for refined cotton. In various compatible manners of stirring supports, pulp dissolving holes, sprinkler heads, a helical blade and an impeller, refined cotton pulp is dissolved at the same time, so that the pulp dissolving efficiency is high, the uniformity of cotton pulp is improved, and the product quality is ensured.

The present disclosure provides a pulp dissolving device for refined cotton, comprising a supporting base, wherein a pulp dissolving unit A is installed on the top of the supporting base, and a pulp discharging unit is installed in front of the pulp dissolving unit A;

a pulp dissolving unit B is installed on the right side of the pulp dissolving unit A, and a pulp dissolving unit C is installed on the pulp dissolving unit A and the pulp dissolving unit B;

the pulp dissolving unit A comprises a pulp dissolving frame, stirring shafts and stirring supports; the pulp dissolving frame is welded to the top of the supporting base; the number of the stirring shafts is two, and the two stirring shafts is rotationally installed on the pulp dissolving frame; and the number of the stirring supports is two rows, and the two rows of stirring shafts are welded to the outside of the two stirring shafts.

In at least some embodiments, the pulping unit A also comprises belt pulleys, a V-belt and a triangular installation rack; the number of the belt pulleys is two, and the two belt pulleys are welded to the outside of the two stirring shafts; the V-belt is installed on the two belt pulleys; and the triangular installation rack is installed on the left side of the pulp dissolving frame through bolts.

In at least some embodiments, the pulp dissolving unit A also comprises a motor A, a linkage disc and semicircular linkage blocks; the motor A is fixedly installed inside the triangular installation rack, and an output shaft of the motor A is connected with the upper stirring shaft; the linkage disc is welded to the right side of the upper stirring shaft; the number of the semicircular linkage blocks is two, and the two semicircular linkage blocks are welded to the right side of the linkage disc.

In at least some embodiments, the pulp discharging unit comprises a pulp discharging pipeline A, a valve, a pulp discharging pipeline B and a motor B; the pulp discharging pipeline A is welded to the front side of the pulp dissolving frame; the valve is installed on the pulp discharging pipeline A; the pulp discharging pipeline B is welded to the bottom of the pulp discharging pipeline A; and the motor B is fixedly installed in front of the pulp discharging pipeline A.

In at least some embodiments, the pulp discharging unit also comprises a pulp discharging shaft, a helical blade and an impeller; the pulp discharging shaft is rotationally installed on the pulp discharging pipeline A, and the pulp discharging shaft is connected with an output shaft of the motor B; the helical blade is welded to the outside of the pulp discharging shaft, and the helical blade is located inside the pulp discharging pipeline A; and the impeller is welded to the outside of the pulp discharging shaft, and the impeller is located inside the pulp discharging pipeline A.

In at least some embodiments, the pulp dissolving unit B comprises a pulp dissolving shell A, a cross-shaped installation rack, circular linkage rods and a rectangular movable block; the pulp dissolving shell A is welded to the right side of the pulp dissolving frame, the bottom of the pulp dissolving shell A is also welded and connected with the supporting base, and five rows of pulp dissolving holes are formed in the pulp dissolving shell A; the cross-shaped installation rack is welded to the inside of the pulp dissolving shell A; the number of the circular linkage rods is two, the two circular linkage rods are slidably installed on the pulp dissolving shell A, and left ends of the two circular linkage rods are provided with rounded angles; and the rectangular movable block is slidably installed inside the pulp dissolving shell A, and the rectangular movable block is also welded and connected with the two circular linkage rods.

In at least some embodiments, the pulp dissolving unit B also comprises a sealing ring A, limit clamping rings, reset springs A and stabilized guide rods; the sealing ring A is installed on the rectangular movable block; the number of the limit clamping rings is two, the two limit clamping rings are welded to the outside of the two circular linkage rods, and the left sides of the two limit clamping rings are in contact with the cross-shaped installation rack; the number of the reset springs A is two, the two reset springs A are installed outside the two circular linkage rods, and the two reset springs A are located between the cross-shaped installation rack and the rectangular movable block; the number of the stabilized guide rods is four, the four stabilized guide rods are welded to the right side of the rectangular movable block, and the four stabilized guide rods are also slidably connected with the cross-shaped installation rack.

In at least some embodiments, the pulp dissolving unit C comprises a water storage tank, a pulp dissolving shell B, sprinkler heads and a water absorption pipeline; the water storage tank is welded to the top of the supporting base; the pulp dissolving shell B is welded to the pulp dissolving frame; the number of the sprinkler heads is three rows, the three rows of sprinkler heads are fixedly installed at the bottom of the pulp dissolving shell B, and one-way valves are installed inside the three rows of sprinkler heads; the water absorption pipeline is welded to the rear side of the pulp dissolving shell B, the water absorption pipeline is inserted into the water storage tank, and a one-way valve is installed inside the water absorption pipeline.

In at least some embodiments, the pulping unit C also comprises linkage connecting rods, a rectangular movable plate and a sealing ring B; the number of the linkage connecting rods is two, the two linkage connecting rods are welded to the left side of the rectangular movable block, and the two linkage connecting rods are also slidably connected with the pulp dissolving shell A; the rectangular movable plate is welded to the left sides of the two linkage connecting rods, and the rectangular movable plate is also in contact with an inner wall of the pulp dissolving shell B; and the sealing ring B is installed on the rectangular movable plate.

In at least some embodiments, a pulp dissolving method for refined cotton using the device comprises the following steps:

firstly, filling a part of water into the pulp dissolving frame, filling a part of water into the water storage tank, then pouring refined cotton to be dissolved into the pulp dissolving frame, and then starting the motor A;

secondly, when the water inside the water storage tank completely enters into the pulp dissolving frame, turning off the motor A to complete pulp dissolving; and thirdly, then turning on the valve and the motor B to discharge refined cotton pulp.

Compared with the prior art, the present disclosure has the following beneficial effects.

Firstly, when the motor B works, the pulp discharging shaft drives the helical blade and the impeller to rotate at the same time. On the one hand, the refined cotton pulp may be assisted to be discharged quickly, on the other hand, the refined cotton pulp may be scattered and stirred by the helical blade and the impeller during pulp discharging, so that the pulp dissolving effect of the refined cotton is further improved.

Secondly, when the linkage disc drives the two semicircular linkage blocks to rotate, the rectangular movable block moves back and forth under the effect of the two semicircular linkage blocks and the two reset springs A. When the rectangular movable block moves rightwards, the refined cotton pulp inside the pulp dissolving frame enters into the pump dissolving shell A through the five rows of pulp dissolving holes. When the rectangular movable block moves leftwards, the cotton pulp inside the pulp dissolving shell A flows back to the pulp dissolving frame through the five rows of pulp dissolving holes. Thus, when the refined cotton pulp passes through the five rows of pulp dissolving holes repeatedly, a good pulp dissolving effect is also achieved, so that the pulp dissolving efficiency and pulp dissolving effect of the refined cotton are further improved.

Thirdly, the rectangular movable block may drive the rectangular movable plate to move during moving. When the rectangular movable plate moves rightwards, water inside the water storage tank enters into the pulp dissolving shell B through the water absorption pipeline. When the rectangular movable plate moves leftwards, water inside the pulp dissolving shell B is sprayed out through the three rows of sprinkler heads, and the refined cotton inside the pulp dissolving frame is washed repeatedly. Under the repeated washing effect of the sprinkler heads, on the one hand, the water sprayed out from the sprinkler heads may play a role in washing and scattering the refined cotton, so that a certain pulp dissolving effect is achieved, on the other hand, sufficient contact with the two rows of stirring supports is also promoted after the refined cotton sinks, so that the stirring effect is enhanced, and the pulp dissolving efficiency is promoted.

Fourthly, in various compatible manners of stirring supports, pulp dissolving holes, sprinkler heads, a helical blade and an impeller, refined cotton pulp is dissolved at the same time, so that the pulp dissolving efficiency is improved, the uniformity of cotton pulp is high, and the product quality is ensured.

DETAILED DESCRIPTION OF THE INVENTION

In an embodiment, as shown in FIG. 1 to FIG. 10, a pulp dissolving device for refined cotton provided by the present disclosure includes a supporting base 1. A pulp dissolving unit A 2 is installed on the top of the supporting base 1, and a pulp discharging unit 3 is installed in front of the pulp dissolving unit A 2.

A pulp dissolving unit B 4 is installed on the right side of the pulp dissolving unit A 2, and a pulp dissolving unit C 5 is installed on the pulp dissolving unit A 2 and the pulp dissolving unit B 4.

Figure 1:
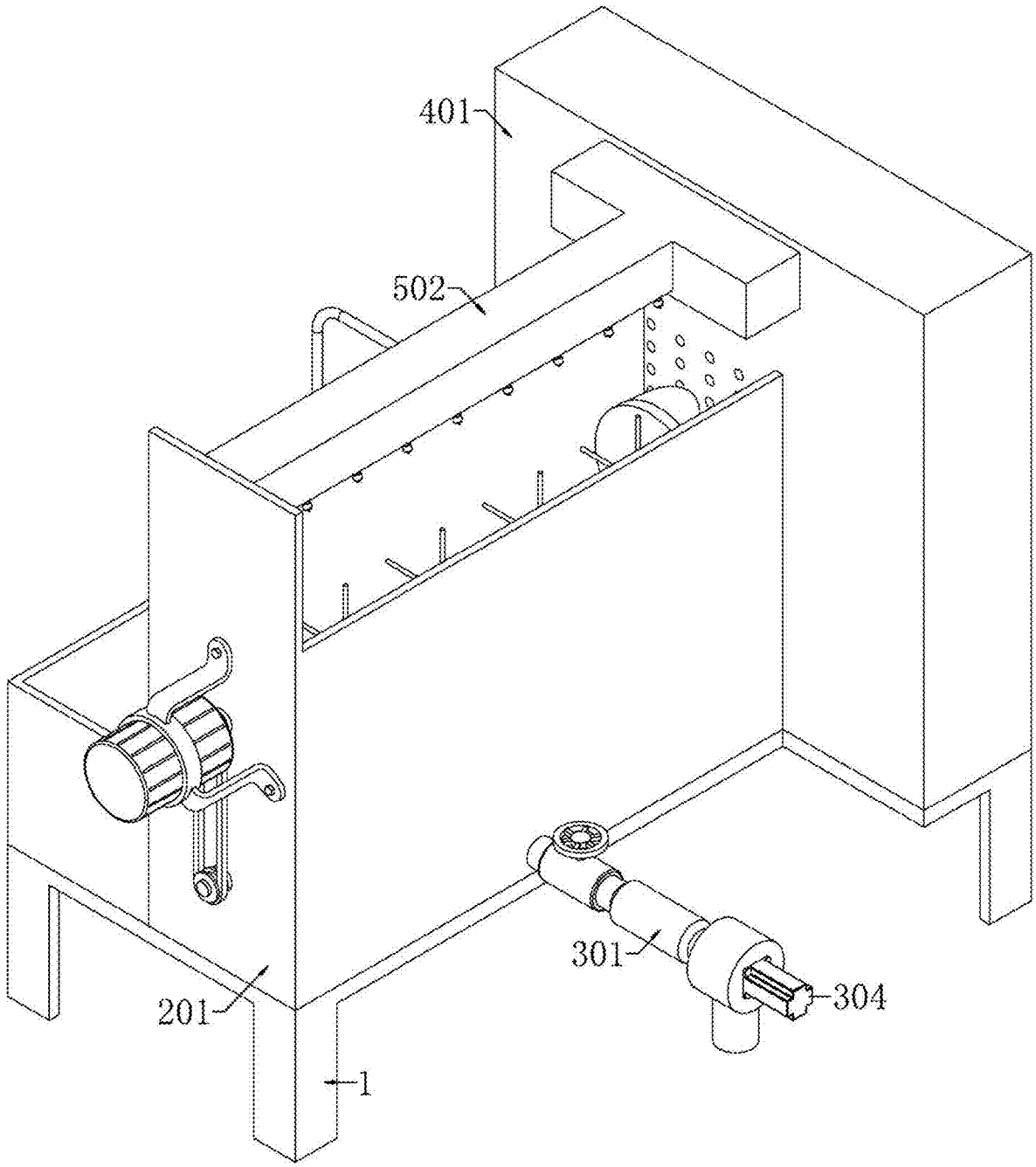
FIG. 1 is a stereoscopic structural schematic diagram of the present disclosure.
Figure 2:
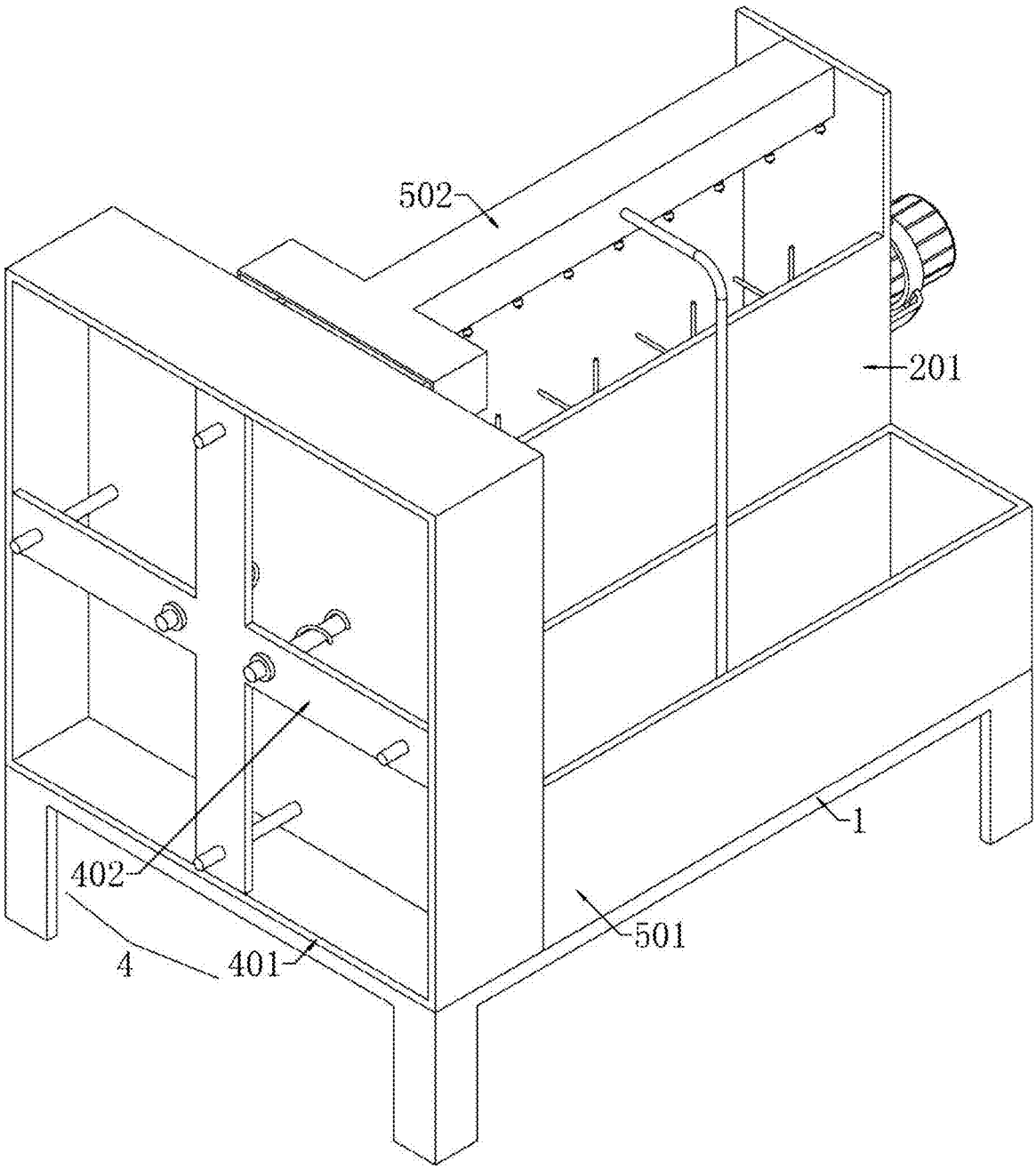
FIG. 2 is a structural schematic diagram of FIG. 1 at a right viewing angle in the present disclosure.
Figure 3:
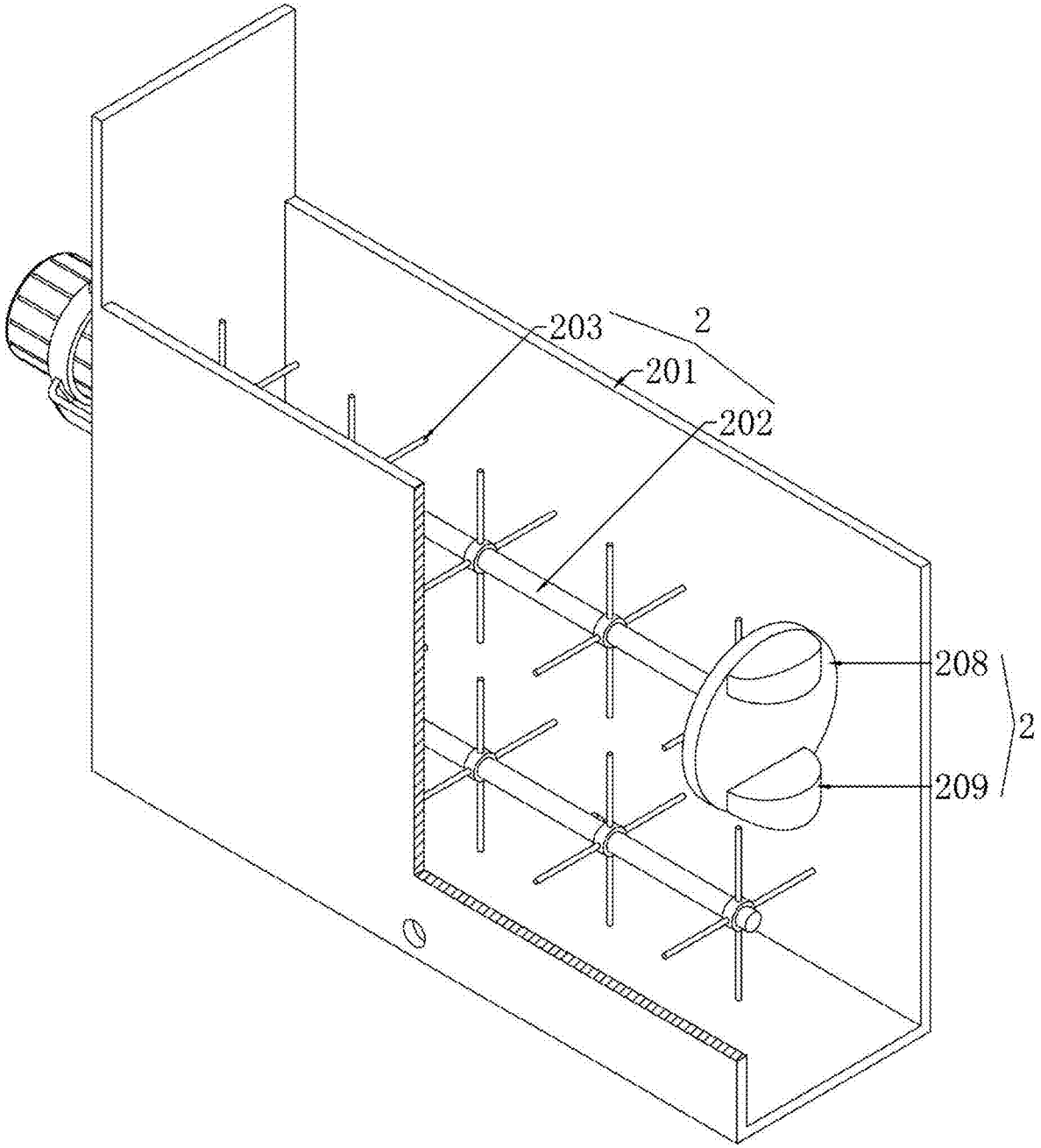
FIG. 3 is a structural schematic diagram of a pulp dissolving unit A in the present disclosure.
Figure 4:
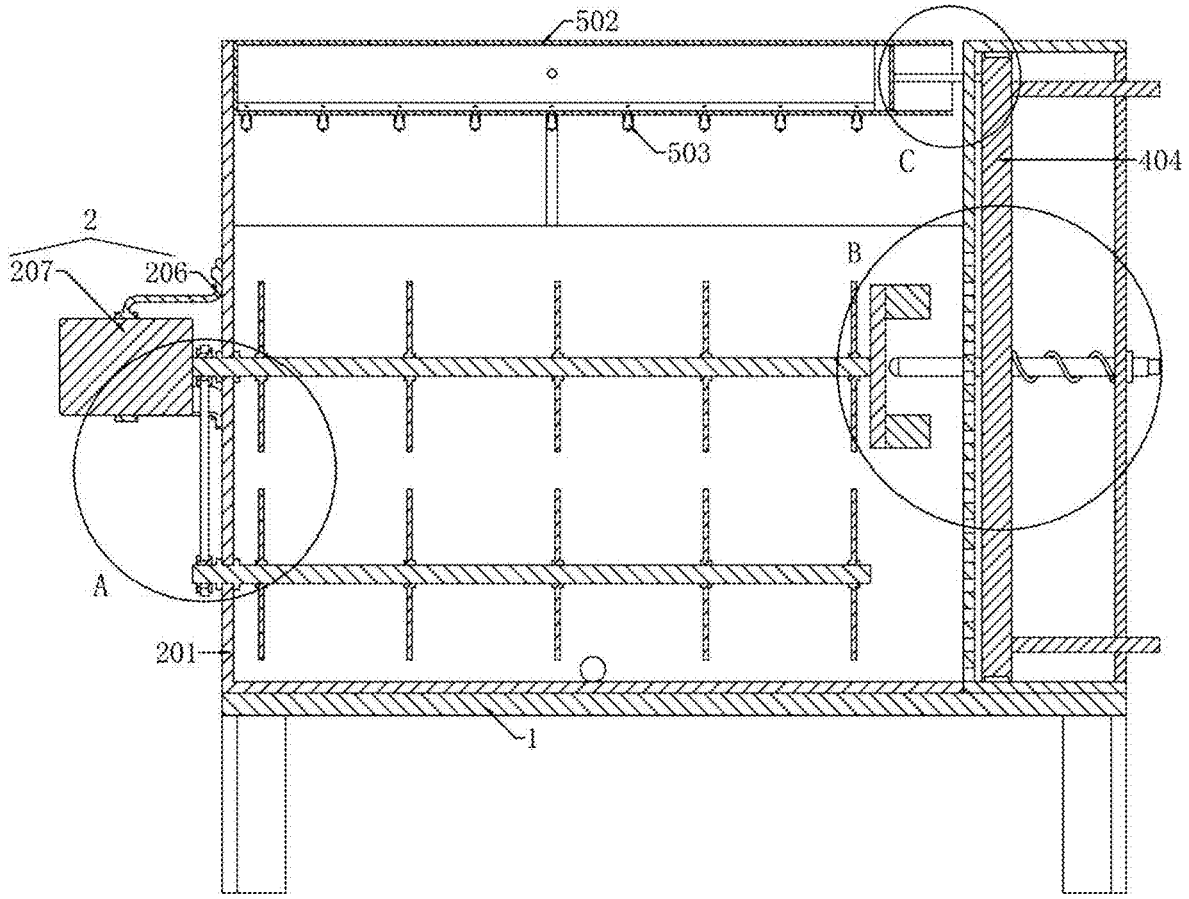
FIG. 4 is a central sectioning structural schematic diagram of FIG. 1 in the present disclosure.
Figure 5:
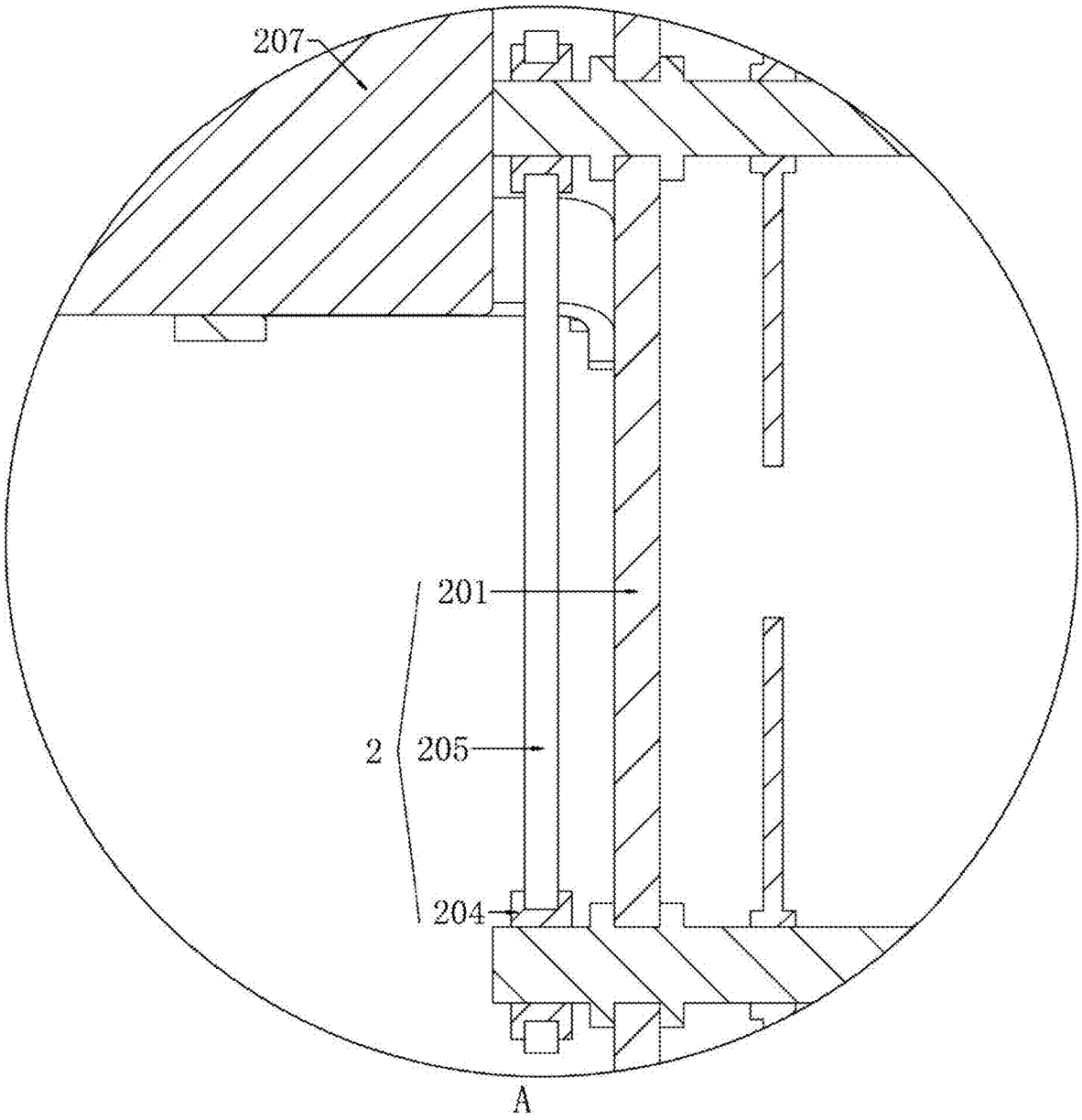
FIG. 5 is a locally enlarged structural schematic diagram of area A in FIG. 4 of the present disclosure.

In the embodiment of the present disclosure, as shown in FIG. 3, FIG. 4 and FIG. 5, the pulp dissolving unit A 2 includes a pulp dissolving frame 201, stirring shafts 202 and stirring supports 203. The pulp dissolving frame 201 is welded to the top of the supporting base 1. The number of the stirring shafts 202 is two, and the two stirring shafts 202 is rotationally installed on the pulp dissolving frame 201. The number of the stirring supports 203 is two rows, and the two rows of stirring shafts 203 are welded to the outside of the two stirring shafts 202. The pulping unit A 2 also includes belt pulleys 204, a V-belt 205 and a triangular installation rack 206. The number of the belt pulleys 204 is two, and the two belt pulleys 204 are welded to the outside of the two stirring shafts 202. The V-belt 205 is installed on the two belt pulleys 204. The triangular installation rack 206 is installed on the left side of the pulp dissolving frame 201 through bolts. The pulp dissolving unit A 2 also includes a motor A 207, a linkage disc 208 and semicircular linkage blocks 209. The motor A 207 is fixedly installed inside the triangular installation rack 206, and an output shaft of the motor A 207 is connected with the upper stirring shaft 202. The linkage disc 208 is welded to the right side of the upper stirring shaft 202. The number of the semicircular linkage blocks 209 is two, and the two semicircular linkage blocks 209 are welded to the right side of the linkage disc 208. Specifically, the two belt pulleys 204 are welded to the outside of the two stirring shafts 202, and the V-belt 205 is installed on the two belt pulleys 204. When the motor A 207 works, the two stirring shafts 202 drive the two rows of stirring supports 203 to rotate, and at the same time, refined cotton pulp inside the pulp dissolving frame 201 is dissolved through the two rows of stirring supports 203 arranged up and down, so that the pulp dissolving efficiency of the refined cotton is effectively improved.

Figure 6:
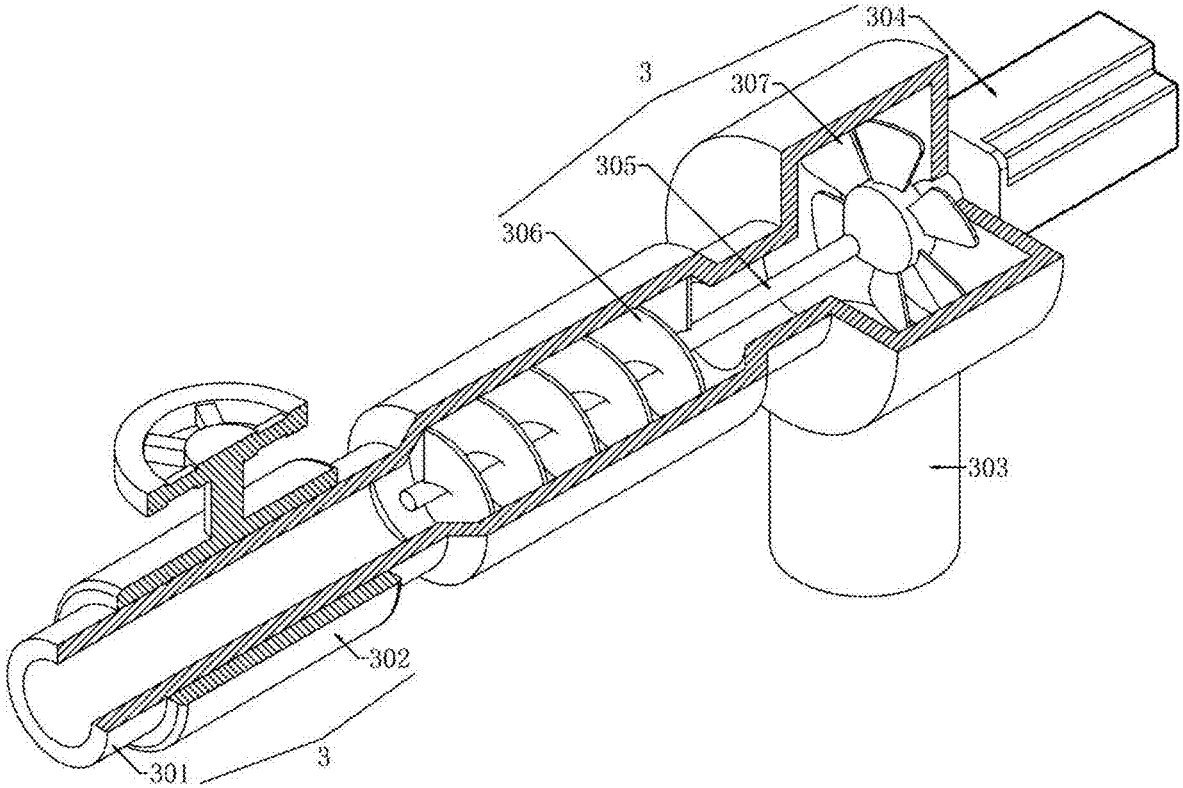
FIG. 6 is a structural schematic diagram of a pulp discharging unit in the present disclosure.

In the embodiment of the present disclosure, as shown in FIG. 6, the pulp discharging unit 3 includes a pulp discharging pipeline A 301, a valve 302, a pulp discharging pipeline B 303 and a motor B 304. The pulp discharging pipeline A 301 is connected and welded to the front side of the pulp dissolving frame 201. The valve 302 is installed on the pulp discharging pipeline A 301. The pulp discharging pipeline B 303 is connected and welded to the bottom of the pulp discharging pipeline A 301. The motor B 304 is fixedly installed in front of the pulp discharging pipeline A 301. The pulp discharging unit 3 also includes a pulp discharging shaft 305, a helical blade 306 and an impeller 307. The pulp discharging shaft 305 is rotationally installed on the pulp discharging pipeline A 301, and the pulp discharging shaft 305 is connected with an output shaft of the motor B 304. The helical blade 306 is welded to the outside of the pulp discharging shaft 305, and the helical blade 306 is located inside the pulp discharging pipeline A 301. The impeller 307 is welded to the outside of the pulp discharging shaft 305, and the impeller 307 is located inside the pulp discharging pipeline A 301. Specifically, the helical blade 306 is welded to the outside of the pulp discharging shaft 305, and the impeller 307 is welded to the outside of the pulp discharging shaft 305. When the motor B 304 works, the pulp discharging shaft 305 drives the helical blade 306 and the impeller 307 to rotate. On the one hand, the refined cotton pulp may be assisted to be discharged, on the other hand, the refined cotton pulp may be scattered and stirred by the helical blade 306 and the impeller 307 during pulp discharging, so that the pulp dissolving effect of the refined cotton is further improved.

Figure 7:
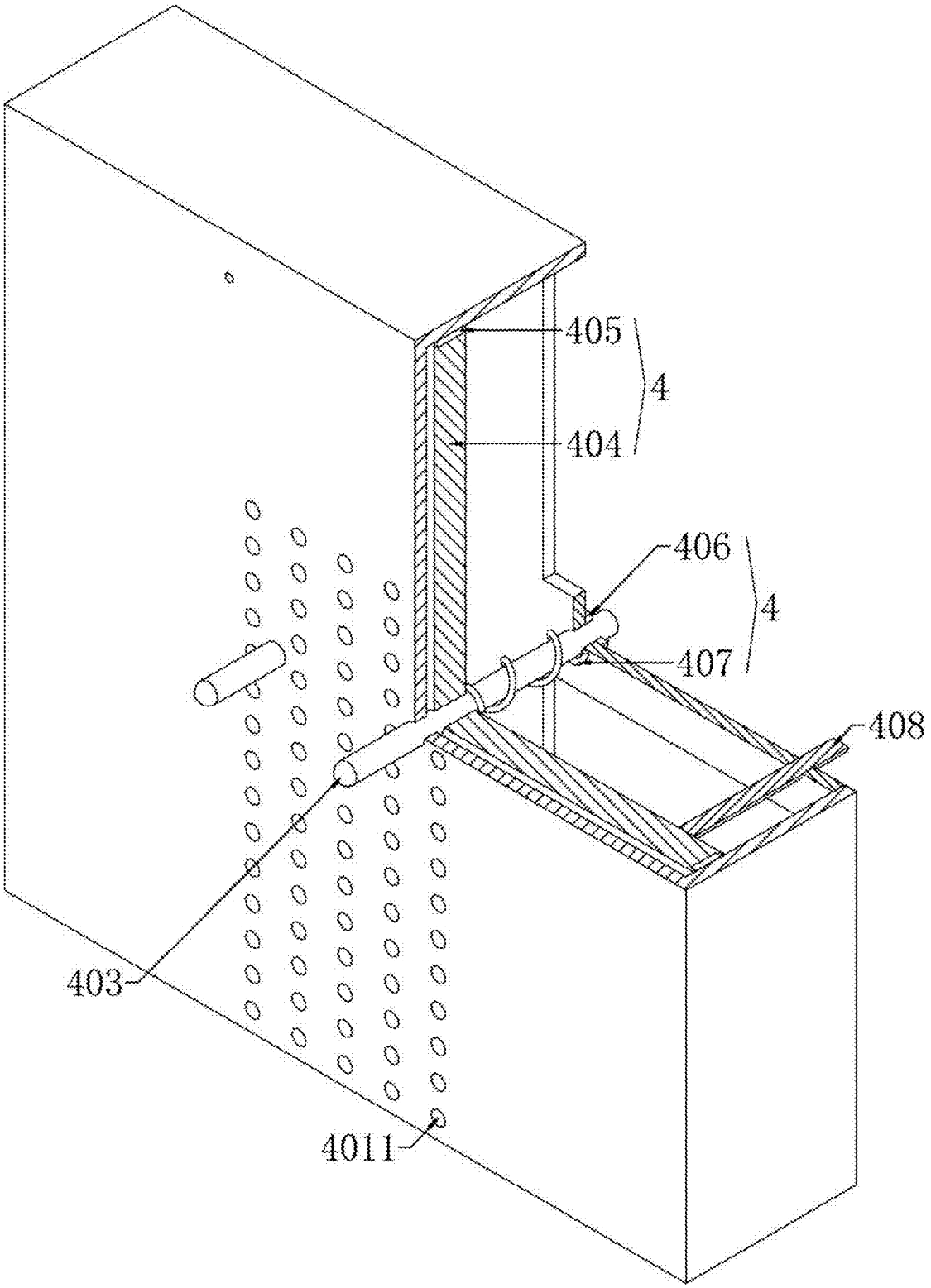
FIG. 7 is a structural schematic diagram of a pulp dissolving unit B in the present disclosure.
Figure 8:
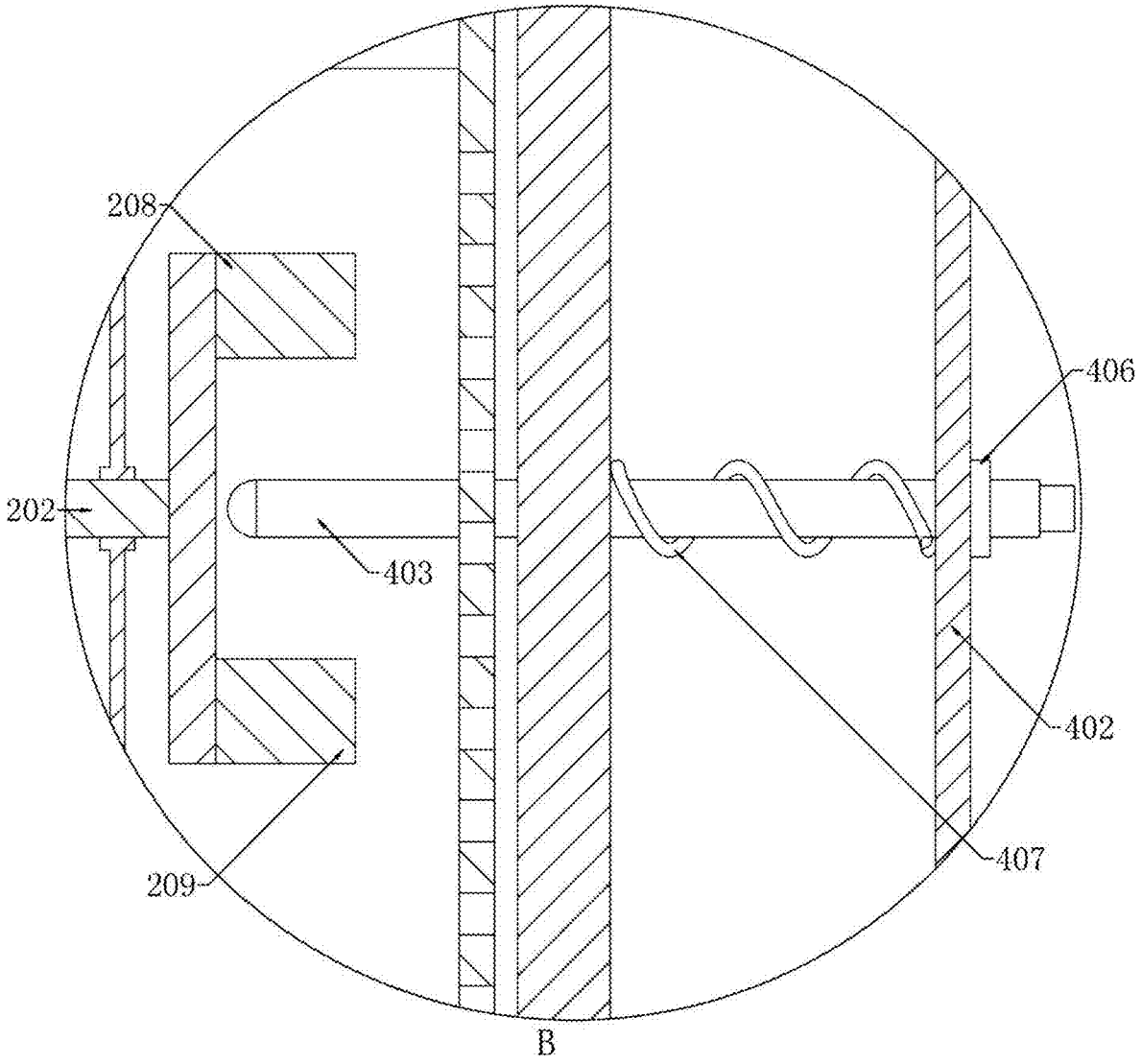
FIG. 8 is a locally enlarged structural schematic diagram of area B in FIG. 4 of the present disclosure.

In the embodiment of the present disclosure, as shown in FIG. 7 and FIG. 8, the pulp dissolving unit B 4 includes a pulp dissolving shell A 401, a cross-shaped installation rack 402, circular linkage rods 403 and a rectangular movable block 404. The pulp dissolving shell A 401 is welded to the right side of the pulp dissolving frame 201, the bottom of the pulp dissolving shell A 401 is also welded and connected with the supporting base 1, and five rows of pulp dissolving holes 4011 are formed in the pulp dissolving shell A 401. The cross-shaped installation rack 402 is welded to the inside of the pulp dissolving shell A 401. The number of the circular linkage rods 403 is two, the two circular linkage rods 403 are slidably installed on the pulp dissolving shell A 401, and left ends of the two circular linkage rods 403 are provided with rounded angles. The rectangular movable block 404 is slidably installed inside the pulp dissolving shell A 401, and the rectangular movable block 404 is also welded and connected with the two circular linkage rods 403. The pulp dissolving unit B 4 also includes a sealing ring A 405, limit clamping rings 406, reset springs A 407 and stabilized guide rods 408. The sealing ring A 405 is installed on the rectangular movable block 404. The number of the limit clamping rings 406 is two, the two limit clamping rings 406 are welded to the outside of the two circular linkage rods 403, and the left sides of the two limit clamping rings 406 are in contact with the cross-shaped installation rack 402. The number of the reset springs A 407 is two, the two reset springs A 407 are installed outside the two circular linkage rods 403, and the two reset springs A 407 are located between the cross-shaped installation rack 402 and the rectangular movable block 404. The number of the stabilized guide rods 408 is four, the four stabilized guide rods 408 are welded to the right side of the rectangular movable block 404, and the four stabilized guide rods 408 are also slidably connected with the cross-shaped installation rack 402. Specifically, the two circular linkage rods 403 are slidably installed on the pulp dissolving shell A 401, left ends of the two circular linkage rods 403 are provided with rounded angles, and the rectangular movable block 404 is also welded and connected with the two circular linkage rods 403. When the linkage disc 208 drives the two semicircular linkage blocks 209 to rotate, the rectangular movable block 404 moves back and forth under the effect of the two semicircular linkage blocks 209 and the two reset springs A 407. When the rectangular movable block 404 moves rightwards, the refined cotton pulp inside the pulp dissolving frame 201 enters into the pump dissolving shell A 401 through the five rows of pulp dissolving holes 4011. When the rectangular movable block 404 moves leftwards, the cotton pulp inside the pulp dissolving shell A 401 returns into the pulp dissolving frame 201 through the five rows of pulp dissolving holes 4011 again. Thus, when the refined cotton pulp passes through the five rows of pulp dissolving holes 4011 repeatedly, a good pulp dissolving effect is also achieved, so that the pulp dissolving efficiency of the refined cotton is further improved.

Figure 9:
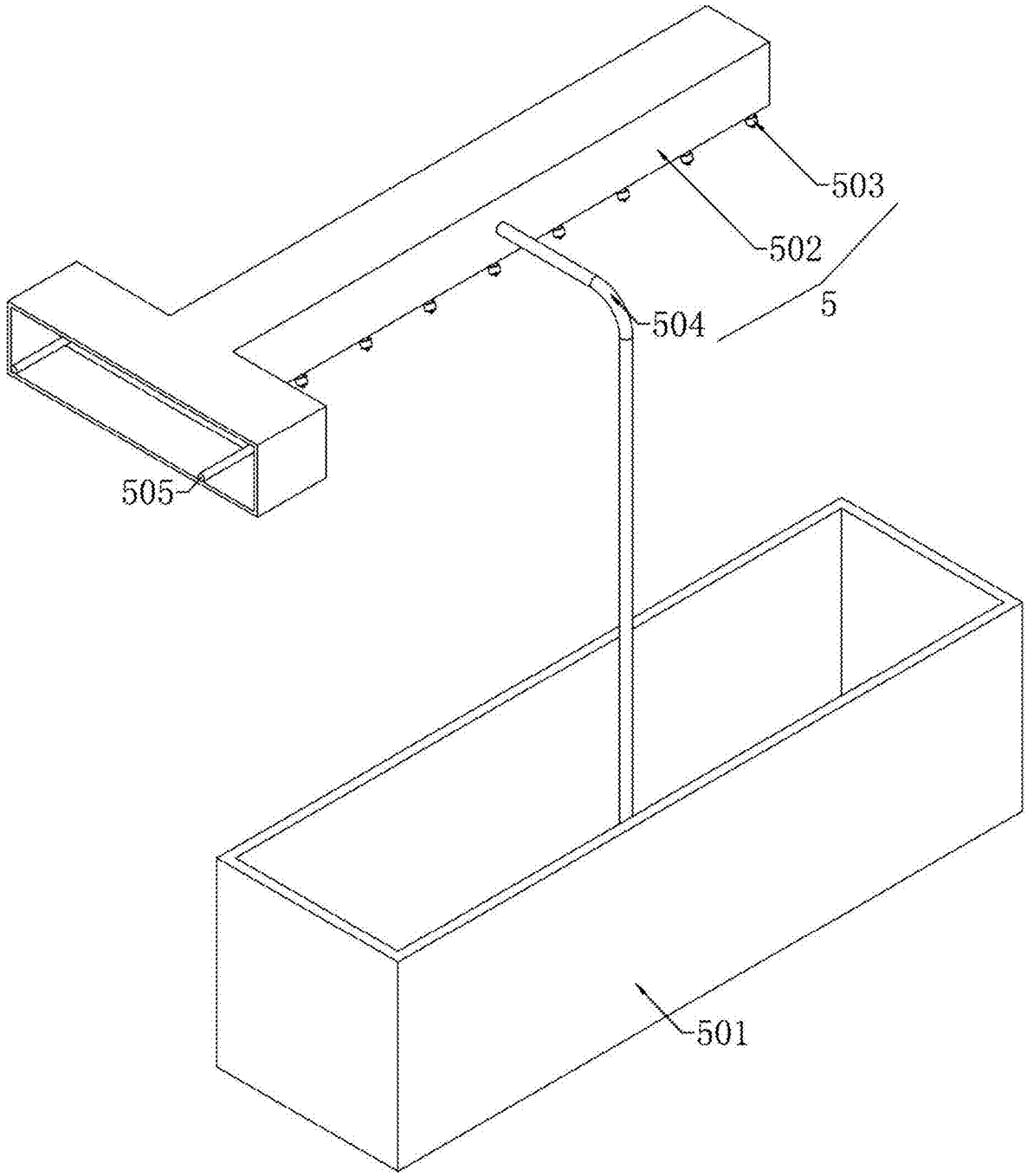
FIG. 9 is a structural schematic diagram of a pulp dissolving unit C in the present disclosure.
Figure 10:
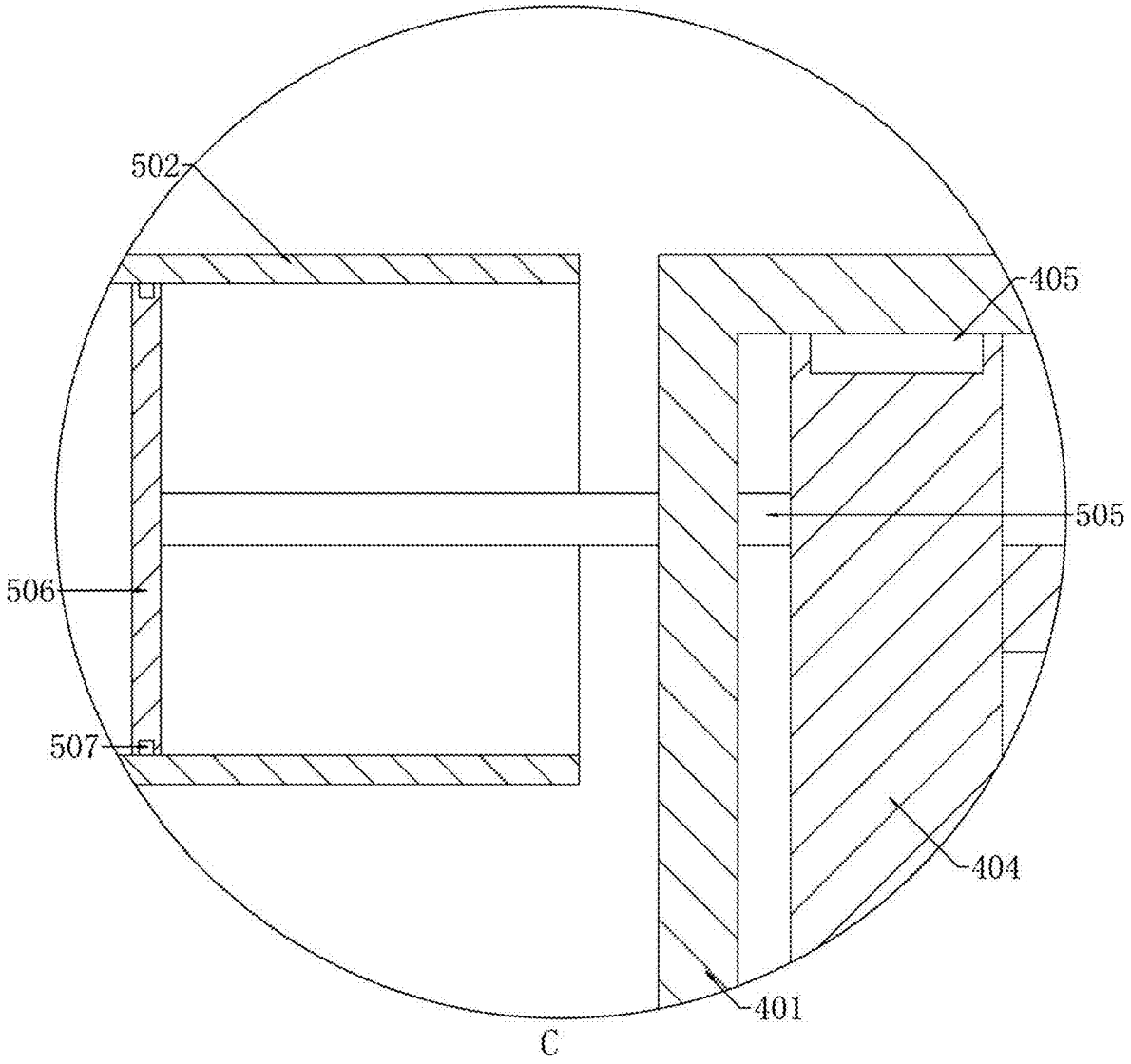
FIG. 10 is a locally enlarged structural schematic diagram of area C in FIG. 4 of the present disclosure.

In the embodiment of the present disclosure, as shown in FIG. 9 and FIG. 10, the pulp dissolving unit C 5 includes a water storage tank 501, a pulp dissolving shell B 502, sprinkler heads 503 and a water absorption pipeline 504. The water storage tank 501 is welded to the top of the supporting base 1. The pulp dissolving shell B 502 is welded to the pulp dissolving frame 201. The number of the sprinkler heads 503 is three rows, the three rows of sprinkler heads 503 are fixedly installed at the bottom of the pulp dissolving shell B 502, and one-way valves are installed inside the three rows of sprinkler heads 503. The water absorption pipeline 504 is welded to the rear side of the pulp dissolving shell B 502, the water absorption pipeline 504 is inserted into the water storage tank 501, and a one-way valve is installed inside the water absorption pipeline 504. The pulping unit C 5 also includes linkage connecting rods 505, a rectangular movable plate 506 and a sealing ring B 507. The number of the linkage connecting rods 505 is two, the two linkage connecting rods 505 are welded to the left side of the rectangular movable block 404, and the two linkage connecting rods 505 are also slidably connected with the pulp dissolving shell A 401. The rectangular movable plate 506 is welded to the left sides of the two linkage connecting rods 505, and the rectangular movable plate 506 is also in contact with an inner wall of the pulp dissolving shell B 502. The sealing ring B 507 is installed on the rectangular movable plate 506. Specifically, the two linkage connecting rods 505 are welded to the left side of the rectangular movable block 404, the two linkage connecting rods 505 are also slidably connected with the pulp dissolving shell A 401, and the rectangular movable plate 506 is welded to the left sides of the two linkage connecting rods 505, so that the rectangular movable block 404 may drive the rectangular movable plate 506 to move during moving. The one-way valves are installed inside the three rows of sprinkler heads 503, and the one-way is installed inside the water absorption pipeline 504. When the rectangular movable plate 506 moves rightwards, water inside the water storage tank 501 enters into the pulp dissolving shell B 502 through the water absorption pipeline 504. When the rectangular movable plate 506 moves leftwards, water inside the pulp dissolving shell B 502 is sprayed out through the three rows of sprinkler heads 503, and the refined cotton inside the pulp dissolving frame 201 is washed repeatedly. Under the repeated washing effect of the sprinkler heads 503, on the one hand, the water sprayed out from the sprinkler heads 503 may play a role in washing and scattering the refined cotton, so that a certain pulp dissolving effect is achieved, on the other hand, sufficient contact with the two rows of stirring supports 203 is also promoted after the refined cotton sinks, so that the stirring effect is enhanced, and the pulp dissolving efficiency is promoted.

In the embodiment of the present disclosure, a pulp dissolving method of refined cotton includes the following steps:

firstly, filling a part of water into the pulp dissolving frame 201, then filling a part of water into the water storage 501, then pouring refined cotton to be dissolved into the pulp dissolving frame 201, and then starting the motor A 207;

secondly, when the water inside the water storage tank 501 completely enters into the pulp dissolving frame 201, turning off the motor A 207 to complete pulp dissolving; and thirdly, then turning on the valve 302 and the motor B 304 to discharge refined cotton pulp.

The specific using manners and effects in the embodiment are as follows.

When the device is used, first a part of water is filled into the pulp dissolving frame 201, then a part of water is filled into the water storage 501, then refined cotton to be dissolved is poured into the pulp dissolving frame 201, and then the motor A 207 is started. When the motor A 207 works, the two stirring shafts 202 drive the two rows of stirring supports 203 to rotate, and the refined cotton pulp is dissolved. When the linkage disc 208 drives the two semicircular linkage blocks 209 to rotate, the rectangular movable block 404 moves back and forth under the effect of the two semicircular linkage blocks 209 and the two reset springs A 407. When the rectangular movable block 404 moves rightwards, the refined cotton pulp inside the pulp dissolving frame 201 enters into the pump dissolving shell A 401 through the five rows of pulp dissolving holes 4011. When the rectangular movable block 404 moves leftwards, the cotton pulp inside the pulp dissolving shell A 401 returns into the pulp dissolving frame 201 through the five rows of pulp dissolving holes 4011 to promote the cotton pulp to pass through the five rows of pulp dissolving holes 4011 repeatedly, so that the refined cotton pulp is dissolved by the pulp dissolving holes 4011. When the rectangular movable plate 506 moves rightwards, water inside the water storage tank 501 enters into the pulp dissolving shell B 502 through the water absorption pipeline 504. When the rectangular movable plate 506 moves leftwards, water inside the pulp dissolving shell B 502 is sprayed out through the three rows of sprinkler heads 503, and the refined cotton inside the pulp dissolving frame 201 is washed repeatedly. Under the repeated washing effect of the sprinkler heads 503, on the one hand, the water sprayed out from the sprinkler heads 503 may play a role in washing and scattering the refined cotton, so that a certain pulp dissolving effect is achieved, on the other hand, sufficient contact with the two rows of stirring supports 203 is also promoted after the refined cotton sinks, so that the stirring effect is enhanced, and the pulp dissolving efficiency is promoted. When water inside the water storage tank 501 completely enters into the pulp dissolving frame 201, the motor A 207 is turned off to complete pulp dissolving. And then, the valve 302 and the motor B 304 are turned on to discharge the refined cotton pulp. When the motor B 304 works, the pulp discharging shaft 305 drives the helical blade 306 and the impeller 307 to rotate. On the one hand, the refined cotton pulp may be assisted to be discharged quickly, on the other hand, the refined cotton pulp may be scattered and stirred by the helical blade 306 and the impeller 307 during pulp discharging, so that the pulp dissolving effect of the refined cotton is further improved.

The invention claimed is:

1. A pulp dissolving device for refined cotton, comprising a supporting base (1), wherein a pulp dissolving unit A (2) is installed on the top of the supporting base (1), and a pulp discharging unit (3) is installed in front of the pulp dissolving unit A (2);

a pulp dissolving unit B (4) is installed on the right side of the pulp dissolving unit A (2), and a pulp dissolving unit C (5) is installed on the pulp dissolving unit A (2) and the pulp dissolving unit B (4);

the pulp dissolving unit A (2) comprises a pulp dissolving frame (201), stirring shafts (202) and stirring supports (203); the pulp dissolving frame (201) is welded to the top of the supporting base (1); the number of the stirring shafts (202) is two, and the two stirring shafts (202) is rotationally installed on the pulp dissolving frame (201); and the number of the stirring supports (203) is two rows, and the two rows of stirring shafts (203) are welded to the outside of the two stirring shafts (202);

wherein the pulp discharging unit (3) comprises a pulp discharging pipeline A (301), a valve (302), a pulp discharging pipeline B (303) and a motor B (304); the pulp discharging pipeline A (301) is welded to the front side of the pulp dissolving frame (201); the valve (302) is installed on the pulp discharging pipeline A (301); the pulp discharging pipeline B (303) is welded to the bottom of the pulp discharging pipeline A (301); and the motor B (304) is fixedly installed in front of the pulp discharging pipeline A (301);

the pulp dissolving unit B (4) comprises a pulp dissolving shell A (401), a cross-shaped installation rack (402), circular linkage rods (403) and a rectangular movable block (404); the pulp dissolving shell A (401) is welded to the right side of the pulp dissolving frame (201), the bottom of the pulp dissolving shell A (401) is also welded and connected with the supporting base (1), and five rows of pulp dissolving holes (4011) are formed in the pulp dissolving shell A (401); the cross-shaped installation rack (402) is welded to the inside of the pulp dissolving shell A (401); the number of the circular linkage rods (403) is two, the two circular linkage rods (403) are slidably installed on the pulp dissolving shell A (401), and left ends of the two circular linkage rods (403) are provided with rounded angles; and the rectangular movable block (404) is slidably installed inside the pulp dissolving shell A (401), and the rectangular movable block (404) is also welded and connected with the two circular linkage rods (403).

2. The pulp dissolving device for refined cotton according to claim 1, wherein the pulping unit A (2) also comprises belt pulleys (204), a V-belt (205) and a triangular installation rack (206); the number of the belt pulleys (204) is two, and the two belt pulleys (204) are welded to the outside of the two stirring shafts (202); the V-belt (205) is installed on the two belt pulleys (204); and the triangular installation rack (206) is installed on the left side of the pulp dissolving frame (201) through bolts.

3. The pulp dissolving device for refined cotton according to claim 2, wherein the pulp dissolving unit A (2) also comprises a motor A (207), a linkage disc (208) and semicircular linkage blocks (209); the motor A (207) is fixedly installed inside the triangular installation rack (206), and an output shaft of the motor A (207) is connected with the upper stirring shaft (202); the linkage disc (208) is welded to the right side of the upper stirring shaft (202); the number of the semicircular linkage blocks (209) is two, and the two semicircular linkage blocks (209) are welded to the right side of the linkage disc (208).

4. The pulp dissolving device for refined cotton according to claim 1, wherein the pulp discharging unit (3) also comprises a pulp discharging shaft (305), a helical blade (306) and an impeller (307); the pulp discharging shaft (305) is rotationally installed on the pulp discharging pipeline A (301), and the pulp discharging shaft (305) is connected with an output shaft of the motor B (304); the helical blade (306) is welded to the outside of the pulp discharging shaft (305), and the helical blade (306) is located inside the pulp discharging pipeline A (301); and the impeller (307) is welded to the outside of the pulp discharging shaft (305), and the impeller (307) is located inside the pulp discharging pipeline A (301).

5. The pulp dissolving device for refined cotton according to claim 1, wherein the pulp dissolving unit B (4) also comprises a sealing ring A (405), limit clamping rings (406), reset springs A (407) and stabilized guide rods (408); the sealing ring A (405) is installed on the rectangular movable block (404); the number of the limit clamping rings (406) is two, the two limit clamping rings (406) are welded to the outside of the two circular linkage rods (403), and the left sides of the two limit clamping rings (406) are in contact with the cross-shaped installation rack (402); the number of the reset springs A (407) is two, the two reset springs A (407) are installed outside the two circular linkage rods (403), and the two reset springs A (407) are located between the cross-shaped installation rack (402) and the rectangular movable block (404); the number of the stabilized guide rods (408) is four, the four stabilized guide rods (408) are welded to the right side of the rectangular movable block (404), and the four stabilized guide rods (408) are also slidably connected with the cross-shaped installation rack (402).

6. The pulp dissolving device for refined cotton according to claim 1, wherein the pulp dissolving unit C (5) comprises a water storage tank (501), a pulp dissolving shell B (502), sprinkler heads (503) and a water absorption pipeline (504); the water storage tank (501) is welded to the top of the supporting base (1); the pulp dissolving shell B (502) is welded to the pulp dissolving frame (201); the number of the sprinkler heads (503) is three rows, the three rows of sprinkler heads (503) are fixedly installed at the bottom of the pulp dissolving shell B (502), and one-way valves are installed inside the three rows of sprinkler heads (503); the water absorption pipeline (504) is welded to the rear side of the pulp dissolving shell B (502), the water absorption pipeline (504) is inserted into the water storage tank (501), and a one-way valve is installed inside the water absorption pipeline (504).

7. The pulp dissolving device for refined cotton according to claim 6, wherein the pulping unit C (5) also comprises linkage connecting rods (505), a rectangular movable plate (506) and a sealing ring B (507); the number of the linkage connecting rods (505) is two, the two linkage connecting rods (505) are welded to the left side of the rectangular movable block (404), and the two linkage connecting rods (505) are also slidably connected with the pulp dissolving shell A (401); the rectangular movable plate (506) is welded to the left sides of the two linkage connecting rods (505), and the rectangular movable plate (506) is also in contact with an inner wall of the pulp dissolving shell B (502); and the sealing ring B (507) is installed on the rectangular movable plate (506).

8. The pulp dissolving device for refined cotton according to claim 6, wherein a pulp dissolving method for refined cotton using the device comprises the following steps:

firstly, filling a part of water into the pulp dissolving frame (201), filling a part of water into the water storage tank (501), then pouring refined cotton to be dissolved into the pulp dissolving frame (201), and then starting the motor A (207);

secondly, when the water inside the water storage tank (501) completely enters into the pulp dissolving frame (201), turning off the motor A (207) to complete pulp dissolving; and thirdly, then turning on the valve (302) and the motor B (304) to discharge refined cotton pulp.

* * * * *